United States Patent [19]

Hansson

[11] Patent Number: 4,799,318

[45] Date of Patent: Jan. 24, 1989

[54] ARRANGEMENT IN THE DRYING SECTION OF A PAPER MACHINE

[75] Inventor: Torbjörn Hansson, Växjö , Sweden

[73] Assignee: Fläkt AB, Nacka, Sweden

[21] Appl. No.: 27,396

[22] Filed: Mar. 18, 1987

[30] Foreign Application Priority Data

Mar. 19, 1986 [SE] Sweden ..... 8601291

[51] Int. Cl.[4] ..... D06F 58/00

[52] U.S. Cl. ..... 34/117; 162/109

[58] Field of Search ..... 34/117, 120; 162/109

[56] References Cited

U.S. PATENT DOCUMENTS

| | | | |
|---|---|---|---|
| 1,670,873 | 5/1928 | Avewson | 34/120 |
| 1,766,096 | 6/1930 | Benedict | 162/108 |
| 3,237,316 | 3/1966 | Sachs | 34/158 X |
| 3,493,463 | 2/1970 | Baker | 162/109 |
| 4,168,200 | 9/1979 | Bilton | 162/186 |
| 4,680,873 | 7/1987 | Fellers et al. | 34/158 X |

*Primary Examiner*—William E. Wayner

*Attorney, Agent, or Firm*—Burns, Doane, Swecker & Mathis

[57] ABSTRACT

The present invention relates to an arrangement in the drying section of a paper machine, preferably the drying section of a cylinder drying machine, for enabling the shrinkage and stretch, of a paper web to be controlled transversely to the direction of web travel with the aid of straps, preferably two, each of which passes through the drying section, and is positioned adjacent to an edge of the paper web for the purpose of imparting to the web a force which is oriented at right angles to the direction of web travel. An adhesive layer is applied to adhere the straps and the edge of the web.

20 Claims, 2 Drawing Sheets

ARRANGEMENT IN THE DRYING SECTION OF A PAPER MACHINE

The present invention relates to an arrangement in the drying section of a paper machine.

Although the present invention can be applied in all kinds of drying sections, it will be described here solely with reference to the drying sections of cylinder drying machines.

The primary object of the invention is to enable the shrinkage and/or stretch of a paper web transversely to the direction in which the web is transported to be controlled with the aid of a number of straps, normally two, which are each intended to extend or to pass through the whole, or a part of the drying section and are positioned in the proximity of the edges of the web in a manner to impart to the paper web during the drying process a force which is oriented at right angles to said transport direction and which acts essentially in the edge regions of the web.

BACKGROUND OF THE INVENTION

The known prior art consists in the methods and arrangements described and illustrated in International Patent Application PCT/SE85/00068 published under International Publication No. WO 85/3534.

The known methods and arrangements are effective in controlling shrinkage and/or stretch of a paper web during a web drying process, by subjecting the paper web to an outwardly directed force during that part of the drying process in which the web has a dry solids content of 75%, and in which the force applied is caused to act in the edge regions of the web.

This known publication proposes various methods for holding the edges of a paper web against the drying cylinders within the drying section during a web drying sequence.

The publication teaches to this end an arrangement which incorporates grooved edges and an arrangement which incorporates slalom wires, or S-wires, and in which a cylinder is provided with two peripheral rings which engage in grooves provided in the wire in a manner to force the web into the grooves. The publication also teaches an arrangement in slalom wires in which the paper web is pressed into and held in two grooves with the aid of strips, and also an arrangement in which edge straps are arranged on both sides of the web in the edge regions thereof and are adapted to hold the edges of the web against the cylinder via grooves formed therearound. The publication also teaches that the edge straps, or bands, can be held to and guided against the cylinder by means of two rings. Finally, the publication discloses an arrangement in which the edge straps are provided with longitudinally extending flanges, such that the flanges of two similarly located edge straps will co-act with and be held firmly against recesses formed in the periphery of the cylinder, preferably adjacent the end walls thereof.

The present invention can be said to be a further development of this latter arrangement.

It will be apparent from the aforegoing that the prior International Application illustrates a plurality of different embodiments for applying oppositely directed forces to the edge portions of a paper web as it passes through the drying sections.

When studying the measures taken to this end it will also be seen that a qualified technical problem resides in the provision of conditions, with the aid of simple means, which will enable the respective edge portions of a paper web to follow a pre-determined path throughout the whole of the drying section, or if so desired throughout a part of said section, and then the forwardly located part of said section, and therewith create conditions for controlling and establishing the extent of web shrinkage and/or web stretch at right angles to the direction of web travel as the web passes through the drying section, thereby realizing the technical advantages recited in the aforesaid publication.

It will also be seen that a technical problem resides in the simple provision of a strap which, while effectively solving the aforesaid technical problem, is of simple construction and cheap to produce.

A further technical problem resides in the provision of a strap which, within reasonable limits, is able to eliminate the risk of accidents at high web speeds.

A related technical problem is one of providing with the aid of simple means conditions for ensuring that the edges of the paper web are firmly held to the strap.

Another technical problem will be seen to exist in creating, with the aid of simple means, conditions which enable the respective edge portions of the web to adhere to the straps through an adhesive layer, preferably applied to one side thereof, and to provide with the aid of simple means conditions for controlling the orientation of the strap through the drying section.

It will also be seen that a technical problem resides in the provision of conditions, with the aid of simple means, with which the adhesive force of the adhesive layer can be made so effective as to resist occurrent tensile forces, preferably forces that occur as a result of the tendency of the web to shrink and/or its inclination to stretch, but which, at the same time, will allow the mutually co-acting edge portions and strap to be separated from one another upon completion of the drying process.

A further technical problem in this regard is one of providing a strap arrangement which can be adapted readily for adhesive co-action with a paper web and which is suitable for use in a drying section of the aforesaid kind.

Another technical problem resides in the provision of a strap which can be incorporated readily in an existing drying section.

It will also be seen that a further problem is one of creating in an existing drying section, with the aid of simple means herefor, conditions which will enable one or more adhesive layers to be applied continuously to either the strap or the edge portions of the paper web.

Another problem in the present context is one of establishing how wide the adhesive layer must be in order to resist the forces that occur while, at the same time, enabling the strap to be parted readily from the web upon completion of the web drying process; a particular problem in this regard is one of enabling the adhesive layer to hold a paper web firmly to a hot elastic strap which has planar surfaces.

It will also be seen that a technical problem resides in the provision of a strap which is suitable for the aforesaid purpose.

SUMMARY OF THE INVENTION

The present invention thus relates to an arrangement in the drying section of a paper machine, and preferably in the drying section of a cylinder drying machine, for the purpose of controlling or positively guiding the shrinkage and/or stretch of a paper web transversely to the direction of web travel in the drying section, with the aid of a number of straps, normally two, each of which is intended to extend or to pass through the whole or part of the drying section and is positioned in the vicinity of the outer edges of the web, so as to apply to the paper web during the drying process a force which is oriented at right angles to the direction of web travel and which acts essentially on respective edge portions of the web.

It is proposed in accordance with the present arrangement that one side of at least one strap of said arrangement, which in principle is described in the aforesaid International Publication with reference to FIG. 10 of the drawings thereof, is created with an adhesive layer which faces the paper web for holding co-action therewith, so that the strap and the respective edge portions of the web are stuck together, or vice versa.

Naturally, both the web and the strap can be provided with a suitable adhesive layer, in order to obtain greater adhesion between the strap and the respective edge portion of the web.

According to a further embodiment of the invention two mutually parallel straps are each provided with an adhesive layer for adhesion to a respective edge portion of the web. The width of the adhesive layers is such as to enable the adhesive bond established between strap and web to withstand the forces that occur when the web shrinks during a drying process, and to withstand the forces that occur when the web is to be stretched across its width, the first mentioned being liable to occur as the straps pass through the drying section in a controlled, optionally convergent fashion, whereas the latter may occur when the straps pass through the drying section in a divergent fashion.

Advantageously, the strap is arranged to be parted from the paper web over a guide roller, therewith to separate the edge portions of the web from respective straps. The respective straps may comprise a thin section and a thicker section, where the thicker section of the strap incorporates one or more longitudinally extending projections or flanges which are intended to co-act with corresponding grooves formed in the peripheral surfaces of the drying cylinders.

The thicker parts of two mutually parallel straps face away from one another while the two thinner parts thereof face towards one another.

According to one advantageous embodiment of the invention the strap comprises a plurality of interjoined strap sections. According to another embodiment, however, the strap may be produced in one single piece, with both the thin and the thicker strap parts being of mutually the same material. In this latter case it is proposed that the thinner part of the strap decreases in thickness towards the centre of the web.

In accordance with a further advantageous embodiment of the invention the strap comprises a relatively thin centre part and two longitudinally extending projections which are symmetrical to the axial plane of said centre part. The thinner part of the strap in this case may have a thickness of less than 5 mm.

The longitudinal projection may be given different cross-sectional shapes, although it is preferred that the projection has a trapezium shaped cross-section and that a co-acting groove of trapezium cross-section is formed in the periphery of the drying cylinder, in the vicinity of one end wall thereof, so as to guide the strap in an effective manner.

The strap, or alternatively parts thereof, is (are) preferably made of a polymeric material.

In order to simplify manufacture of the strap it is proposed that the thinner strap part comprises a plastics material, preferably a polyamide, polyester or polyurethane plastic, or a combination thereof.

In order to enable the thicker strap part to withstand the tension and compression forces which act on the outer surfaces thereof as it passes over guide rollers or the like, it is proposed that this thicker strap part is made of a rubber material or polyurethane suitable for this purpose.

In accordance with one preferred embodiment of the invention the adhesive layer is applied to the strap and/or to the paper web immediately prior to the time at which the strap and the paper web are to be brought into co-action with one another. The adhesive may be applied by suitable spraying or roll brushing or pencilling methods.

The adhesive layer may conveniently comprise a coating of starch, in which case the strap shall be hot when applying the adhesive thereto, preferably above 50° C. Polymer based adhesives may also be used.

It is recommended that the dry solids content of the web is less than 75%, preferably higher than 40%, when bringing the web into bonding co-action with the strap.

In accordance with one embodiment of the invention the paper web is adhered to the strap while the web is located in the free draw and in the initial part of the drying section.

Furthermore, the adhesive layer is preferably positioned on that part of the strap located nearest the centre of the web.

Finally, it lies within the scope of the invention to permit at least that part of the strap on which an adhesive coating is to be applied to be coated with a suitable release agent which will enable the adhesive material to relinquish its hold on the strap more readily subsequent to drying the paper web in the drying section.

Alternatively, means may be provided for cutting away the edge portions of the paper web upon completion of the web drying process, and further means may be used to separate the cut paper strips from the strap. In this latter case, the paper strips will accompany the strap through some small distance during its travel to the reeling section, during which time the paper strips can be removed from respective straps and the straps returned for re-use in the paper machine.

Those advantages primarily afforded by an arrangement according to the present invention reside in the creation of conditions, with the aid of simple means, with which the shrinkage and/or stretch of a paper web in a direction transversely to the direction of web travel can be controlled simply by adhering the web to at least one strap which passes or extends through the drying section and is guided by the drying cylinders thereof.

BRIEF DESCRIPTION OF THE DRAWINGS

Preferred embodiments exhibiting characteristics significant of the present invention will now be described in more detail with reference to the accompanying drawings, in which.

DETAILED DESCRIPTION

Figure 1:
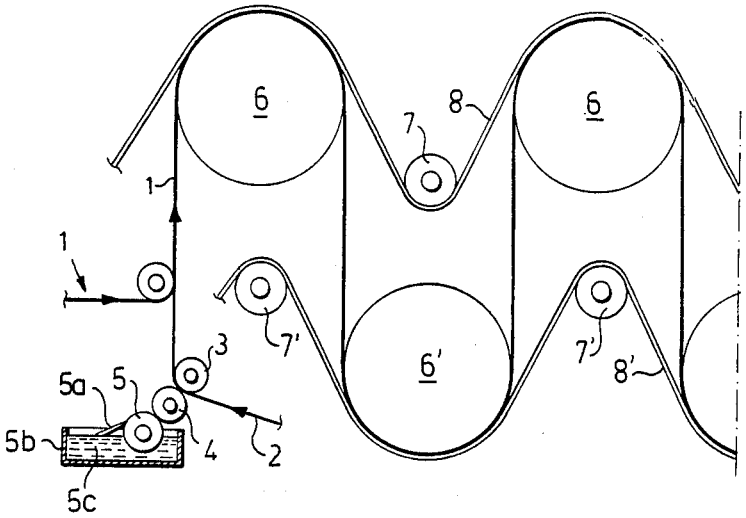
FIG. 1 illustrates schematically and in side view the forward part of a drying section incorporated in a paper machine.

FIG. 1 illustrates schematically and in side view a forward part of the drying section of a paper machine, comprising upper drying cylinders 6 and lower drying cylinders 6', and upper guide rolls 7 and lower guide rolls 7'. The paper web to be dried is referenced 1. The drying felt extending over the upper drying cylinder 6 and the upper guide rollers 7 is referenced 8, while the lower drying felt is referenced 8'.

Thus, the present invention relates to an arrangement in the drying section of a paper machine for enabling the shrinkage and/or stretch of the paper web to be controlled and guided transversely to the direction of web travel with the aid of a plurality of straps, in the illustrated embodiment two straps 2, **2*a***, each of which is intended to extend or to pass through the whole of the drying section, or through a part thereof, and is positioned adjacent a respective edge part of the paper web, in order to impart to the web a force which is oriented at right angles to the direction of web travel and which acts essentially in the respective edge parts of the web.

To this end it is proposed in accordance with the invention that two substantially parallel straps 2, **2*a* shall be arranged to pass over a guide roller 3 and that an adhesive layer for bonding co-action with the paper web 1 is coated on the side of respective straps 2, 2*a* facing the paper web 1**.

Although the invention is described with reference to the use of two straps 2, **2*a*** coated with an adhesive layer, it will be understood that solely one strap can be coated with an adhesive layer for co-action with one edge part of the paper web, while the other edge part of the web is arranged to co-act with a known mechanical clamping means or the like.

The layer of adhesive is applied in a known manner, either with the aid of a spray nozzle or, as illustrated, with the aid of an applicator roller 4 which co-acts with a roller 5, a doctor blade **5*a* and a container 5*b* that contains a liquid adhesive substance 5*c***.

Although the illustrated embodiment the adhesive is applied solely to one side of the strap 2, it will be understood that adhesive can also be applied to one side of the paper web 1, and then particularly to one side of the edge portion of the web. Alternatively, both the straps 2, **2*a*** and the edge portions of the web may be provided with such an adhesive layer.

It is essential, however, that the two straps 2, **2*a* and the edge portions 1*a* of the paper web 1** are caused to adhere to one another, and it is also important that the width of the adhesive layer is sufficient to enable the bond established to resist the forces that occur when the paper web shrinks and/or stretches.

The straps 2 and **2*a* are assigned a movement path through the drying section which is adapted to the stretching ratio desired. If it is desired to stretch the paper web across the whole of the web width present in the entrance to the drying section, the straps 2, 2*a*** shall diverge through the desired part of the drying section, i.e. the distance between the straps is greater for each drying cylinder.

If the web is only to be stretched to a slight extent, the straps 2, **2*a*** shall converge, and then solely to a negligibly lesser extent than the natural decrease in width of a paper web on which no stretching action is taken.

Figure 2:
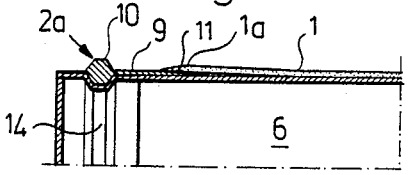
FIG. 2 is a front view of a drying cylinder, and illustrates a flanged strap in co-action with holding recesses formed in the periphery of the cylinder, preferably in the vicinity of the end walls of the cylinder.

FIG. 2 is a front view, partially in section, of a drying cylinder 6 with which a strap **2*a*** co-acts around the cylinder periphery adjacent one end wall of the cylinder. A similar strap co-acts with the oppositely located peripheral surface of the cylinder and end wall thereof.

The strap **2*a* comprises a thin section 9, which rests against the peripheral surface of the cylinder, and a thicker section 10**.

The adhesive layer 11 is made effective to hold the edge part **1*a* of the web 1** firmly, despite the forces acting towards the centre of the paper web during the drying process.

Although the felt 8 is not shown in FIG. 2, it will be understood that the felt is positioned over the web 1, and preferably also somewhat inwardly over the adhesive layer 11.

Although not shown in FIG. 1, it will be obvious that the two edge parts **1*a* of the paper web shall be arranged to part from respective straps 2*a* at the terminal end of the drying section. This can be effected by causing respective straps to be parted from the paper web over a guide roller, such as the guide roller 3**, while permitting the paper web to continue along its movement path.

Figure 3:
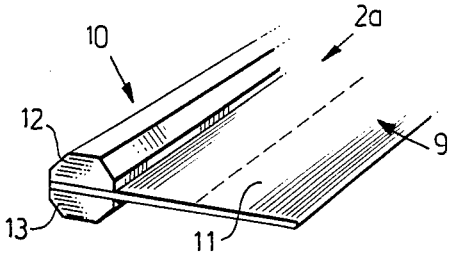
FIG. 3 is a perspective view of a strap of the kind illustrated in FIG. 2.

The configuration of the strap **2*a* is shown in more detail in FIG. 3, from which it can be seen that the thicker part 10 of the strap comprises two longitudinally extending projections, a projection 12 on the upper side of the strap and a projection 13 on the underside thereof, said projections being intended to co-act with grooves 14 formed in the periphery of the drying cylinder adjacent the end walls thereof. It will also be seen from FIG. 2 that when two mutually parallel extending straps 2, 2*a* are arranged adjacent a respective edge portion of the paper web 1, the thicker parts 10 of the straps shall face away from one another while the thinner parts 9** of said straps shall face towards one another.

As will be seen from FIG. 3, the adhesive layer 11 shall have a width extension which occupies at least 25% and at most 75% of the total surface of the thinner strap part 9. The total width may be 30 cm and the width of the adhesive layer may be about 10 cm.

The adhesive layer 11 is applied to that part of the strap or the strap surface 9, which faces towards the centre of the web 1, i.e. away from the thicker part 10.

Figure 4:
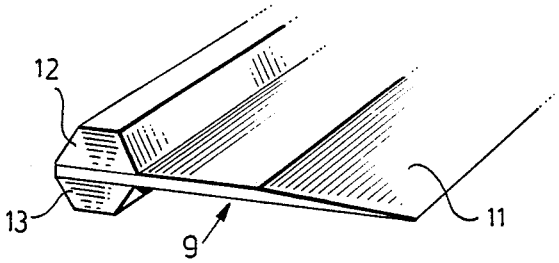
FIG. 4 illustrates an alternative embodiment of the strap.

As illustrated in FIG. 4, the thinner part 9 of the strap has a thickness which decreases towards the centre of the paper web, and a particular advantage is afforded when the adhesive material is applied to this surface of decreasing thickness.

In the embodiment illustrated in FIGS. 3 and 4 the strap comprises a thin centre part and two projections 12, 13 which are symmetrical with respect to the axial centre plane of the strap. Preferably, the thinner part of the strap has a thickness beneath 5 mm, preferably a thickness of between 0.5 and 2.0 mm.

As illustrated in FIG. 1, the paper web 1 is attached to the strap 2 and the strap **2*a*** in the free draw and at the beginning of the drying section.

The longitudially extending projections of the FIGS. 3 and 4 embodiment have a trapezium-shaped cross-section, although it will be understood that the projections may have other suitable cross-sectional shapes.

The thinner part 9 of respective straps is suitably made of a polymeric material, particularly a plastics material, such as polyamide, or polyester and/or polyurethane, while the thicker part of the strap is made of a rubber material, since the outer parts of this strap part are perforce subjected to considerable stretching and tension forces when the strap is passed over guide rollers or the like 3.

As illustrated in FIG. 1, the adhesive layer is applied to a strap immediately prior to the time at which the strap shall be brought into co-action with the paper web.

The strap may pass through the whole of the drying section, or through a first part thereof. The strap may also extend through all drying sections. Web guide tracks may be provided on the peripheral surfaces of the drying cylinders adjacent respective end walls thereof. These guide tracks may comprise a plurality, such as four, extruded aluminium profiles which are positioned adjacent one another.

A further roller, additional to the roller 4, may be arranged for coating one edge part of the paper web. An additional roller may also be provided for the other edge part, so that adhesive layers on respective straps 2, 2a. The adhesive is preferably a starch capable of establishing a bond of sufficient strength in the direction of web travel and also capable of enabling the strap to be released from the paper web readily at the end of the drying section.

The strap is preferably hot when the adhesive layer is applied, and preferably has a temperature in excess of 50° C.

The paper web is brought into co-action with the strap at a location in the drying section in which the paper web has a dry solids content of about 40%, or slightly thereabove.

Finally, it lies within the scope of the invention to provide at least that part of the strap to which an adhesive material is applied with a substance which will enable the paper web to be separated from the strap more readily, subsequent to drying the paper web in the drying section.

Alternatively, means may be provided for cutting away the edge parts of the paper web at the end of the drying section, these separated paper strips being removed from the strap with the aid of further means provided herefor.

This will mean that a separated paper strip will accompany the strap during its travel to the web reeling section, during which time the strips can be removed from the straps and the straps returned for re-use in the paper machine.

The adhesive substance used may advantageously be the substance sold under the designation "Moughton Rezosol 8207".

Figure 5:
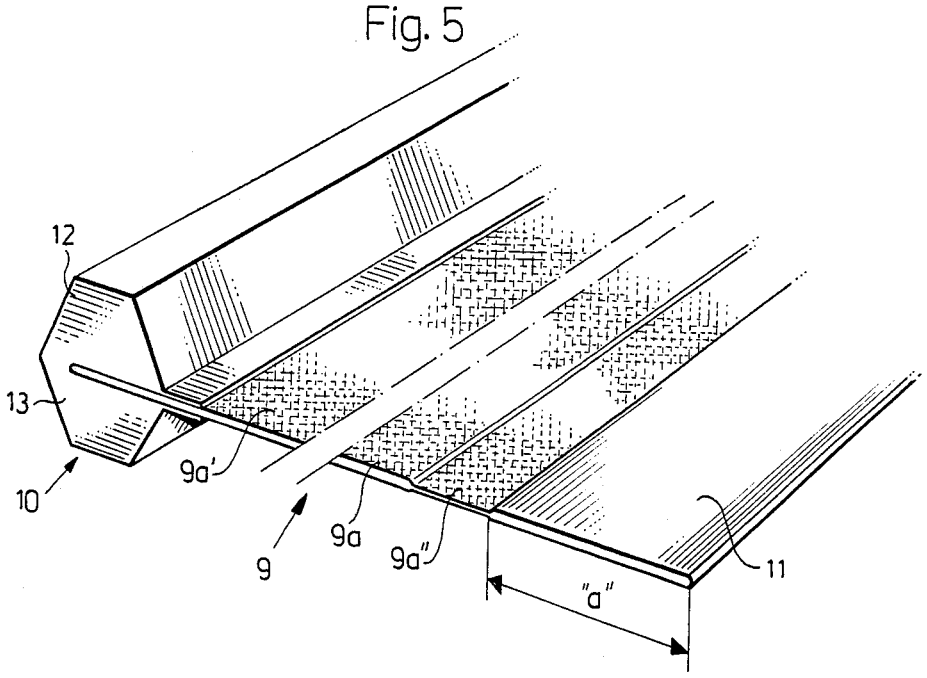
FIG. 5 illustrates a further alternative embodiment of a strap according to the invention.

FIG. 5 illustrates a further alternative embodiment of a strap constructed in accordance with the invention.

With regard to this embodiment, and also with the aforedescribed embodiments, it will be noted that the part of the strap to be coated with an adhesive layer 11 comprises a material that has a tendency toward hydrogen bonds, such as polyamide. This has the advantage of a greater bond strength with increasing dry solids contents. One requisite herefor is, of course, that the adhesive used contains hydrogen for effecting the bond.

When the invention is applied in a paper drying machine, the paper already has the ability to bind hydrogen.

Thus, it will be seen that by pre-heating the strap, and then particularly the part 11 thereof, conditions are created for obtaining improved adhesion.

The adhesive material preferably comprises a water-soluble polymer, such as polyvinyl alcohol.

In FIG. 5 a strap having a thicker rubber part 10 presenting trapezium shaped parts 12 and 13 is joined to a fabric material 9a. This fabric material shall have a width which is so adapted to the drying section concerned that the part 11 can be positioned on the edge part 1a of the paper web.

The part 11 has a length of from 10 to 50 mm and a length which is adapted to the desired width of the adhesive bead.

The web material 9a has a thicker part 9a' adjacent the part 10, and a thinner part 9a'' adjacent the part 11''.

It will be understood that the invention is not restricted to the aforedescribed embodiments, and that modifications can be made within the scope of the following claims.

What is claimed is:

1. A paper drying apparatus comprising:

means for guiding a moving paper web along a path through said drying apparatus including web engaging drying cylinders mounted in said drying apparatus;

means for controlling shrinkage of said web, said means including at least one strap mounted for movement with said web, said strap including a first section for adhering attachment to an edge of said web and a second section for engagement with a co-acting means on said drying cylinders; and means for coating an adhesive layer between said strap and said web for adhering said strap to said edge of said web.

2. The apparatus of claim 1, wherein said strap tensions said web in a direction transverse to said path.

3. The apparatus of claim 1, wherein said adhesive layer comprises from about 25% to about 75% of said surface of said first section of said strap.

4. The apparatus of claim 3, wherein said first section of said strap has a thickness of from about 0.5 mm to about 2.0 mm.

5. The apparatus of claim 4, wherein said first section of said strap is formed of a plastic material and said second section of said strap is formed of a rubber material.

6. The apparatus of claim 1, wherein said first section of said strap includes a portion formed of a material compatible with a hydrogen bond, said adhesive layer comprising a water-soluble polymer.

7. The apparatus of claim 6, wherein said portion comprises a suitable fabric material.

8. A paper drying apparatus comprising:

means for guiding a moving paper web along a path through said drying apparatus including web engaging drying cylinders mounted in said drying apparatus; and means for controlling shrinkage of said web, said means including at least one strap mounted for movement with said web, said strap including a first section for adhering attachment to an edge of said web and a second section for engagement with a co-acting means on said drying cylinders;

wherein said drying cylinders have a groove formed in a surface thereof.

9. The apparatus of claim 8, wherein said second section of said strap is correspondingly shaped for mating engagement with said groove.

10. A paper drying apparatus comprising:

means for guiding a moving paper web engaging drying cylinders mounted in said said drying apparatus;

means for controlling shrinkage of said web by tensioning said web in a direction transverse to said path, said means including a pair of substantially parallel straps, said straps mounted for movement with said web, each strap including a first section for attachment to opposed edge portions of said web, respectively, and each strap also including a second section for engagement with a co-acting means on said drying cylinders; and means for coating a surface of said first section of each strap with an adhesive layer for adhering said straps to said opposed edge portions.

11. The apparatus of claim 10, wherein the straps have been heated to a temperature in excess of 50 degrees C. when the adhesive layer is coated on said surface.

12. A paper drying apparatus, comprising:

means for controlling shrinkage of a paper web, said shrinkage controlling means including at least one strap mounted to said web for movement with said web through said paper drying apparatus, said strap including a first section for adhering to an edge of said web and a second section for engagement with said paper drying apparatus;

means for guiding the paper web along a path through said drying apparatus including means for engaging the second section of the strap; and means for coating an adhesive layer between said strap and said web for adhering said strap to said edge of said web.

13. The apparatus of claim 12, wherein said strap tensions said web in a direction transverse to said path.

14. A paper drying apparatus, comprising:

means for controlling shrinkage of a paper web, said shrinkage controlling means including at least one strap mounted to said web for movement with said web through said paper drying apparatus, said strap including a first section for adhering to an edge of said web and a second section for engagement with said paper drying apparatus;

means for guiding the paper web along a path through said drying apparatus including means for engaging the second section of the strap; and wherein said engagement means includes rollers having a groove formed in a surface thereof.

15. The apparatus of claim 14, wherein said second section of said strap is correspondingly shaped for mating engagement with said groove.

16. A paper drying apparatus, comprising:

means for controlling shrinkage of a paper web, said shrinkage controlling means including at least one strap mounted to said web for movement with said web through said paper drying apparatus, said strap including a first section for adhering to an edge of said web and a second section for engagement with said paper drying apparatus;

means for guiding the paper web along a path through said drying apparatus including means for engaging the second section of the strap; and wherein said first section of said strap is formed of a plastic material and said second section of said strap is formed of a rubber material.

17. A paper drying apparatus, comprising:

means for guiding a moving paper web along a path through said drying apparatus;

means for controlling shrinkage of said web by tensioning said web in a direction transverse to said path, said shrinkage controlling means including a pair of substantially parallel straps, said straps mounted to said web for movement with said web, each strap including a first section for attachment to opposed edge portions of said web, respectively, and each strap also including a second section for engagement with said guiding means on said drying apparatus; and means for coating a surface of said first section of each strap with an adhesive layer for adhering said straps to said opposed edge portions.

18. The apparatus of claim 17, wherein the straps have been heated to a temperature in excess of 50 degrees C. when the adhesive layer is coated on said surface.

19. The apparatus of claim 17, wherein the guiding means include rollers having a groove formed in a surface thereof.

20. The apparatus of claim 19, wherein said second section of said strap is correspondingly shaped for mating engagement with said groove.

* * * * *